United States Patent [19]

Harris

[11] Patent Number: 5,051,544

[45] Date of Patent: Sep. 24, 1991

[54] TRANSMISSION CABLE WITH REDUCED PREPARATION TIME TERMINATION SECTION

[75] Inventor: Wayne Harris, Wallingford, Conn.

[73] Assignee: Amphenol Corporation, Wallingford, Conn.

[21] Appl. No.: 517,336

[22] Filed: May 1, 1990

[51] Int. Cl.[5] ..... H01B 7/08

[52] U.S. Cl. ..... 174/117 F; 156/51; 156/52; 156/55; 174/34; 174/117 AS

[58] Field of Search ..... 174/117 F, 117 FF, 117 PC, 174/117 A, 34; 156/51, 52, 55

[56] References Cited

U.S. PATENT DOCUMENTS

| | | | |
|---|---|---|---|
| 2,964,587 | 12/1960 | Minot | 174/117 A |
| 3,173,991 | 3/1965 | Breakfield, Sr. | 174/117 FF |
| 3,833,443 | 9/1974 | Naseth et al. | 156/55 |
| 4,113,335 | 9/1978 | Lang et al. | 174/72 A X |
| 4,149,026 | 4/1979 | Fritz et al. | 174/117 F X |
| 4,367,585 | 1/1983 | Elliott et al. | 29/857 |
| 4,375,379 | 3/1983 | Luetzow | 174/117 F X |
| 4,381,420 | 4/1983 | Elliott et al. | 174/34 |
| 4,513,170 | 4/1985 | Apodaca | 174/36 |
| 4,552,988 | 11/1985 | Haderer | 174/74 R |
| 4,678,864 | 7/1987 | Cox | 174/36 |
| 4,698,457 | 10/1987 | Bordbar | 174/36 |

FOREIGN PATENT DOCUMENTS

| | | | |
|---|---|---|---|
| 235072 | 6/1925 | United Kingdom | 174/117 F |
| 403688 | 12/1933 | United Kingdom | 174/117 F |

*Primary Examiner*—Morris H. Nimmo
*Attorney, Agent, or Firm*—Bacon & Thomas

[57] ABSTRACT

A ribbon cable carrying ground and signal wires in a single plane includes, at predetermined intervals, separator materials inserted between the signal wires and the ground wires to facilitate separation upon termination. A method for manufacturing such a cable includes the steps of separately guiding the signal and ground wires to a lamination station, and means for inserting the separator material between the signal and ground wires at predetermined intervals prior to lamination.

14 Claims, 5 Drawing Sheets

FIG. 1A

FIG. 1
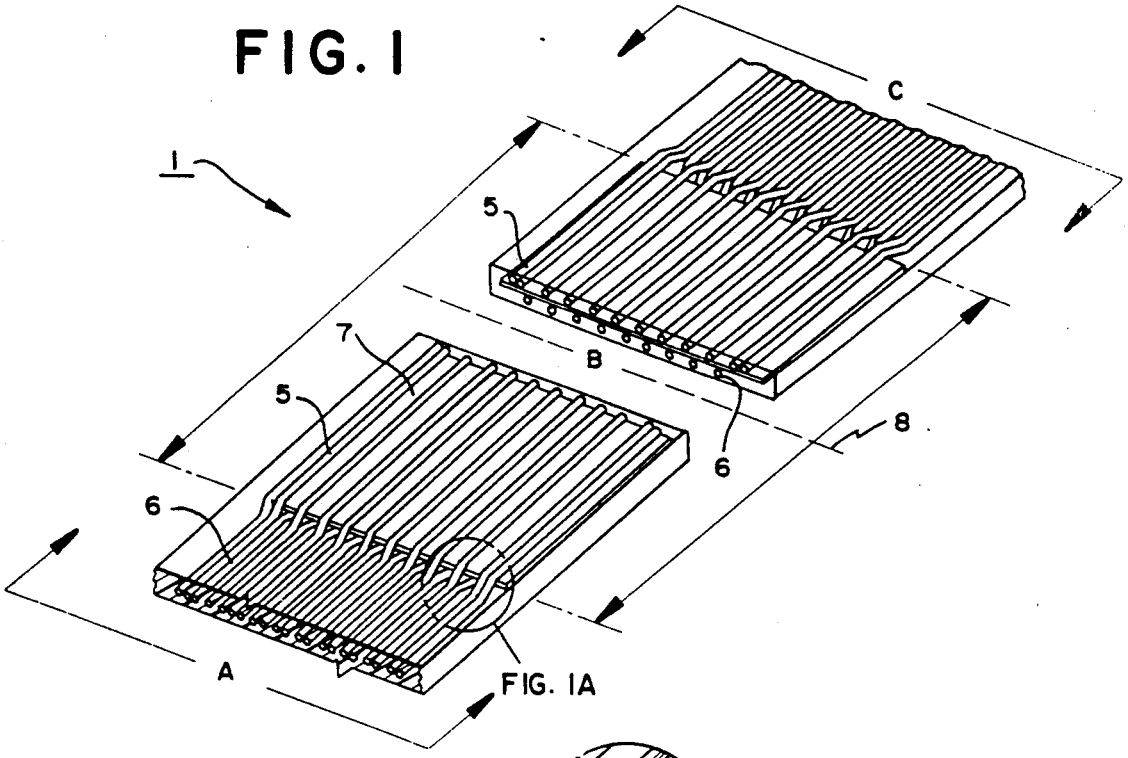
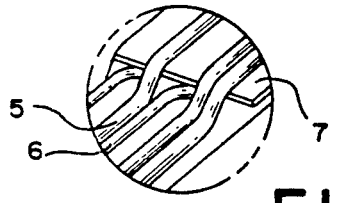
FIG. 1A
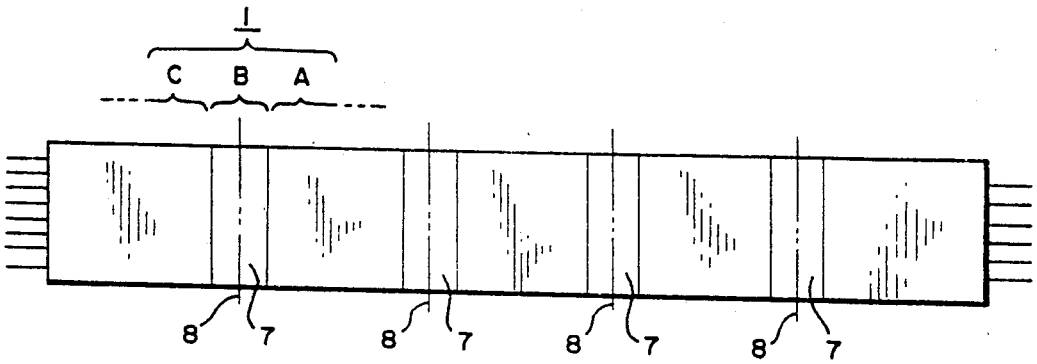
FIG. 4

FIG. 3a'
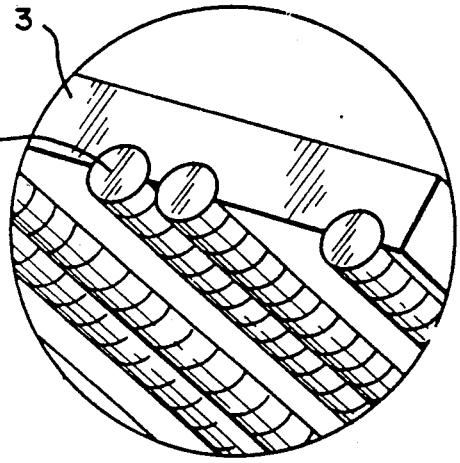
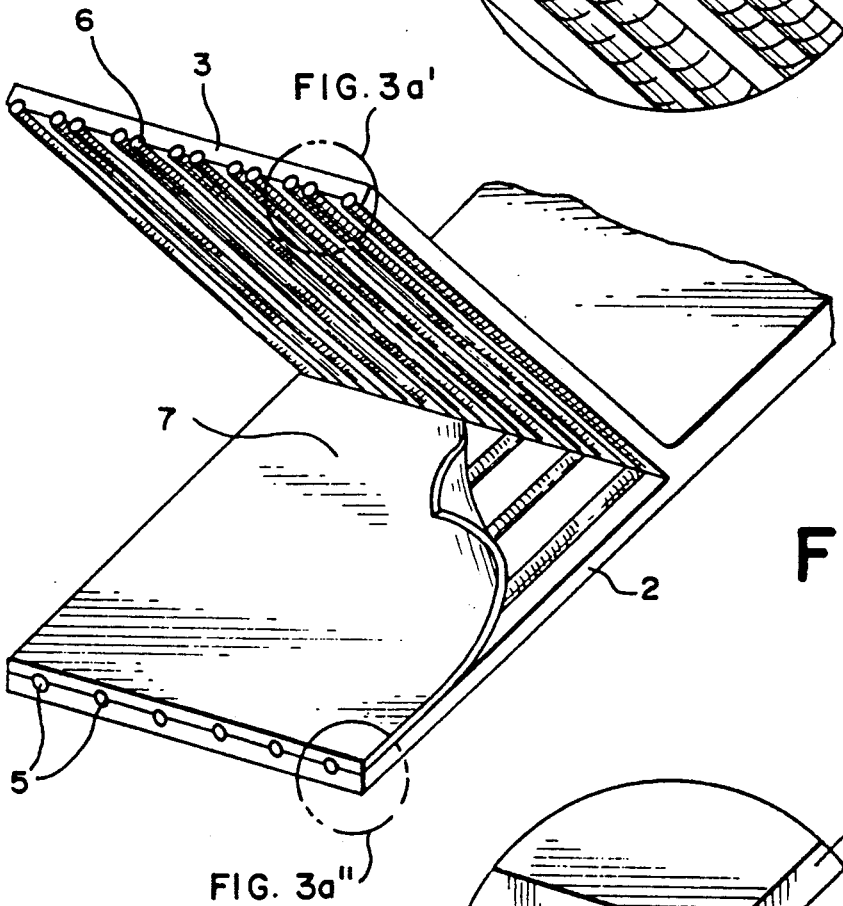
FIG. 3a
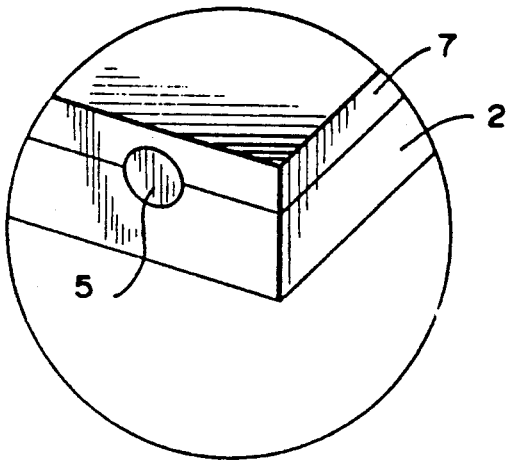
FIG. 3a''

FIG. 3b"

TRANSMISSION CABLE WITH REDUCED PREPARATION TIME TERMINATION SECTION

BACKGROUND OF THE INVENTION

1. Field of the Invention

The present invention relates to electrical cables and, in particular, to ribbon cables of the type in which a plurality of wires ar encapsulated between flexible insulating layers.

2. Description of Related Art

Flat or ribbon cables are useful in a variety of applications in which multiple discrete signals must be carried on separate wires in a restricted space. Because of the number of different signals which may be carried simultaneously by the cable, it is desirable to isolate individual signal wires by placing ground wires between the signal wires. The ground wires prevent electrical fields in the signal wires from inducing undesired electrical currents in neighboring signal wires, the ground wires being connected to a constant potential source, as is well known in the art.

In such cables, a difficulty arises in that the ground and signal wires require separate termination. Generally, in order to terminate or splice the cable, the dielectric material which comprises the insulation for the cable must be removed, after cutting the cable to a desired length, in order to make possible separation of the ground wires from the signal wires. Because the signal and ground wires are packed closely together in a single plane, separation may itself be difficult.

A prior solution to this problem has been to provide a continuous release layer between laminated insulation layers of the cable, thus facilitating peeling apart of the insulation layers. However, wires are still located in a single plane, making sorting and separation of the wires difficult.

Another solution has been to use isolating strips placed at predetermined intervals in the cable to prevent bonding of upper cable and lower cable insulating layers in order to facilitate separation when the cable is cut in those areas. Again, however, the signal wires and ground wires are maintained in the same plane even in the areas where termination is to occur, thus requiring separation of the ground and signal wires prior to termination.

SUMMARY OF THE INVENTION

It is an object of the invention to provide a transmission style cable having reduced cable preparation time during termination, and a method of manufacturing such a cable.

This object is accomplished by separating the signal and ground wires within the cable for as long a length as is deemed necessary for allowing termination. A separator or isolation member is inserted into the cable to keep the ground wires apart from the signal wires. The separator also prevents the ground and signal wires from being completely encapsulated by the dielectric material, allowing for easy access to the wires for the purpose of termination.

The advantage to the end user is that when the cable is cut across in the area of the isolation member the ground wires are already separated from the signal wires, saving a step in the termination process.

In an especially advantageous embodiment of the invention, the isolation members are formed from a dielectric material with anti-adhesion properties such as polytetrafluoroethylene (PTFE) or any material made from a combination of PTFE, such as PTFE/FEP, for the purpose of facilitating separation.

BRIEF DESCRIPTION OF THE DRAWINGS

FIG. 1 is a perspective view of a ribbon cable section according to a preferred embodiment of the invention.

FIGS. 3*a* and 3*b* show the manner in which the ground and signal wires are separated according to the preferred embodiment of the invention.

FIG. 4 shows a complete cable including several sections of the type shown in FIGS. 1–3.

DESCRIPTION OF THE PREFERRED EMBODIMENT OF THE INVENTION

FIGS. 1, 2, 3*a*, and 3*b* show a ribbon cable section 1 according to the preferred embodiment of the invention, including signal wires 5 and ground wires 6 encapsulated between two layers 2 and 3 of an insulating material. The materials used for the insulating layers and wires are conventional and it is intended that the present invention be applied to wires and insulation of any materials which might occur to those skilled in the art.

Figure 2A:
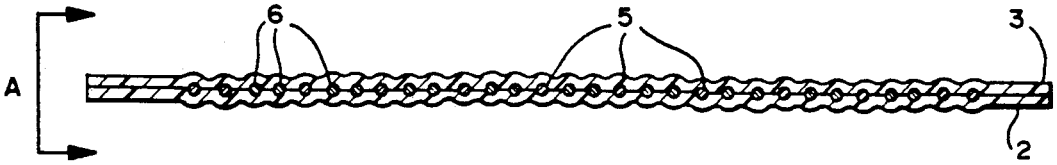
FIG. 2*a*, 2*b* and 2*c* show a cross section of each of the portions A, B, and C of the ribbon cable section of FIG. 1.
Figure 2B:
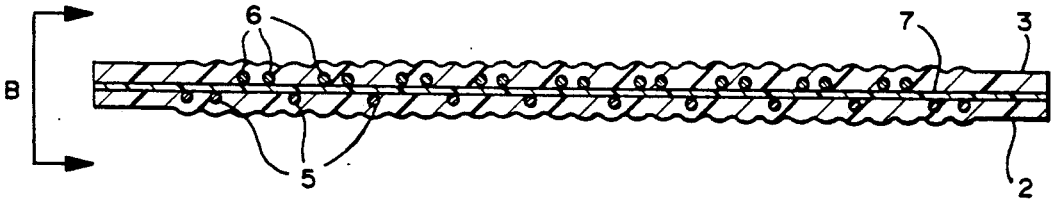
Figure 2C:
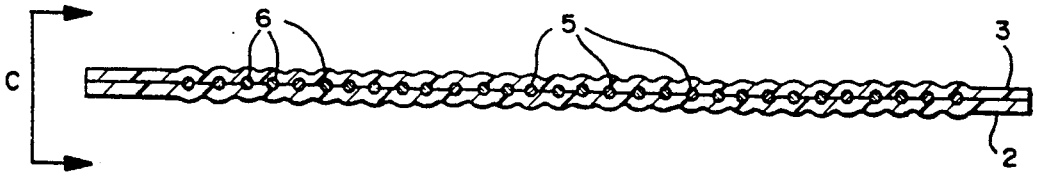

For purposes of illustration, the cable section 1 shown in FIGS. 1 and 2 is divided into three sections, A, B, and C. In sections A and C, the ground wires 6 and signal wires 5 are arranged in a single plane. These sections extend between sections B of the cable and cover the desired length of the finished cable assembly specified by the user. FIG. 4 shows the manner in which section 1 combines with other cable sections to form a complete uncut cable which may be cut by the user along lines 8 to form individual cables having pre-separated ground and signal wires at their ends.

It will be noted that the ground and signal wires may be arranged in a plurality of different configurations, the specific embodiment shown in FIGS. 1, 2, 3*a*, and 3*b* including two ground wires between each of the signal wires, except for the endmost signal wires. For example, it is also possible to provide a single ground wire, or more than two ground wires, between each signal wire, and it is also within the scope of the invention to provide for adjacent signal wires. Finally, it will be appreciated that it is within the scope of the invention to include signal or ground wires which are only partially in a single plane.

In section B, which is the section to be terminated, the ground and signal wires are separated in different planes by an isolation member or separator 7 formed of a dielectric material such as polytetrafluoroethylene. Polytetrafluoroethylene is especially advantageous because of its anti-adhesion and dielectric properties although additional materials with similar properties will occur to those skilled in the art. For example, other suitable materials include polyethylene, polyvinyl chloride, polytrifluorochloroethylene, and polyethylene terephthalate.

As a result of the above-described placement of separators 7, in order to use the cable of the preferred embodiment, it is simply necessary to cut the cable along any of lines 8, as shown in FIG. 4. The cable sections will readily separate leaving the signal and ground wires apart from each other.

Figure 3B:
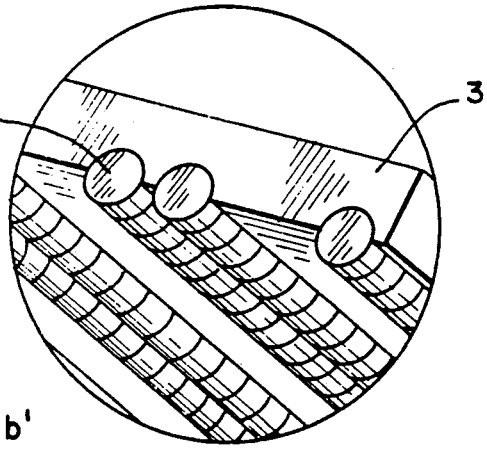
Figure 3B:
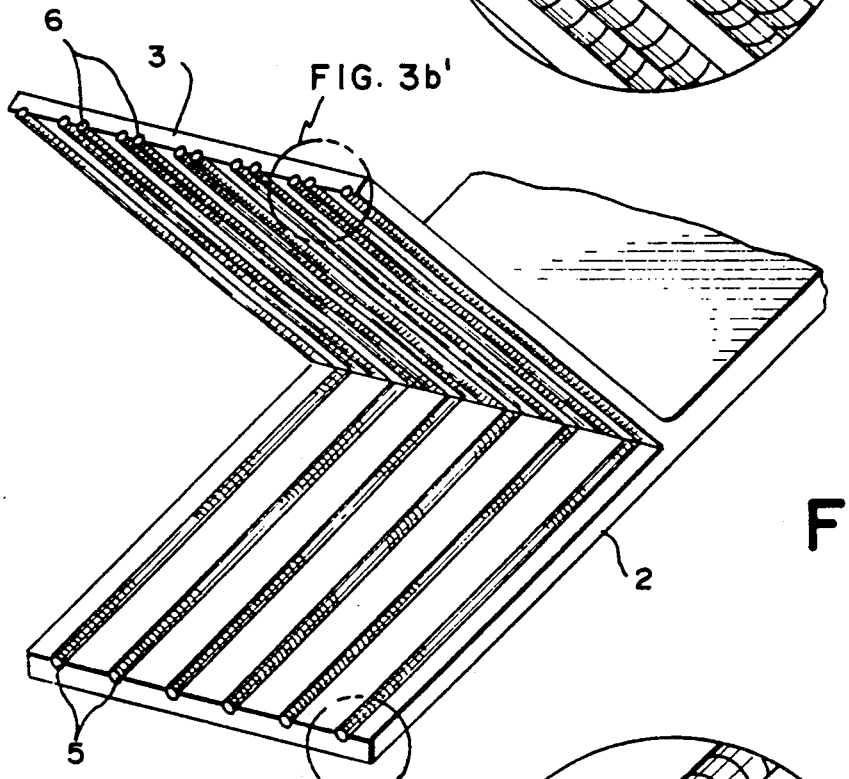
Figure 3B:
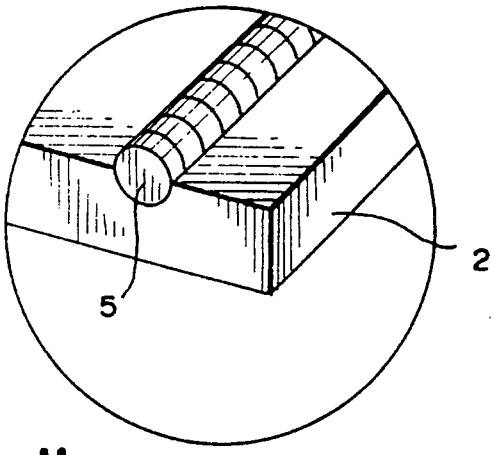

As is best shown in FIG. 3*a*, separator 7 may, in a preferred embodiment, remain attached to either the signal or ground side of the cable after separation of the cable sections. The separator 7 may then be peeled away to leave the signal and ground wires exposed on one side but still partially embedded in the insulation material, at which time the end user may terminate the cable by any method that best fits his requirements For example, the cable may be terminated by first removing all of the remaining insulation, or the cable may be terminated with the insulation in place. FIG. 3*b* shows the cable after peeling away of separator 7.

Figure 5:
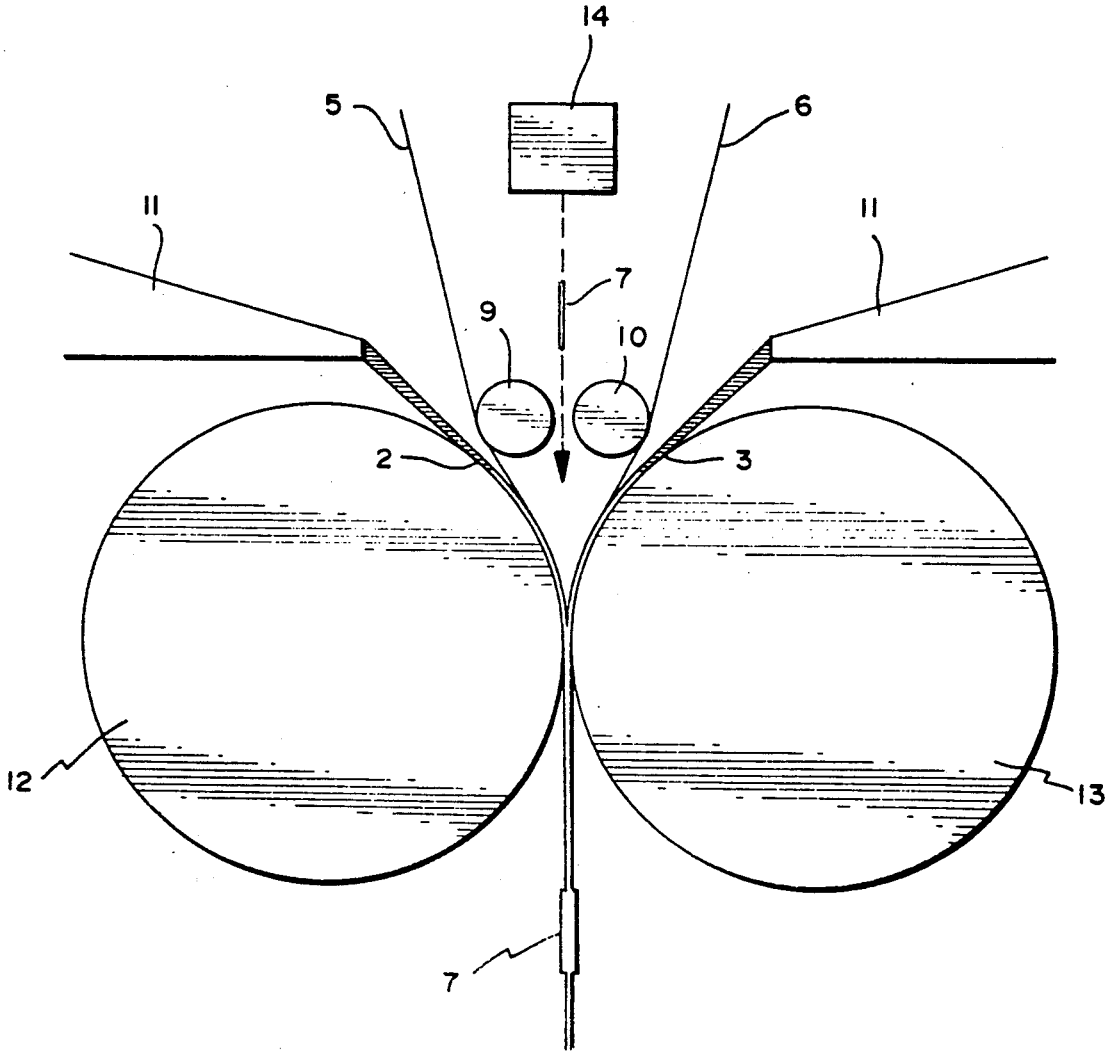
FIG. 5 is a schematic of the preferred method by which the cable of the preferred embodiment is manufactured.

FIG. 5 is a schematic of an apparatus which may be used for manufacturing the ribbon cable of the preferred embodiment. Reference numerals 12 and 13 denote two bonding of pressure rollers which make up a laminating station and which are used for laminating two plastic films extruded from slit dies 11. Such rollers and slit dies are well known in the art of cable manufacture. In addition, guide rollers 9 and 10 are provided for separately guiding the respective signal and ground wires between the bonding rollers 12 and 13 according to a predetermined pattern, for example the pattern shown in FIG. 2. The bonding and/or the guide rollers may include grooves for the purpose of locating the wires laterally, and other suitable guide means may also be provided.

This apparatus may be used to form the ribbon cable of the preferred embodiment as follows: At predetermined intervals, precut insulating members or pieces of a separator material, such as polytetrafluoroethylene, are inserted between the signal wires 5 and ground wires 6 by inserting means 14 prior to entry of the wires into the laminating station. This will prevent the two laminating layers 2 and 3 from adhering to each other and yet maintain partial embedding of the respective signal and ground wires into the respective laminated layers. Inserting means 14 may be mechanical, for example an arm or conveyor, or operated by gravity or pneumatic pressure. Numerous other means for inserting the members 7 will inevitably occur to those skilled in the art.

The insertion may be carried out at any predetermined intervals depending on the desired lengths of the planar portions of the cable. The greater the interval between insertions, the greater the length of the resulting cable sections.

It will of course be appreciated that numerous other variations will occur to those skilled in the art. For example, it is within the scope of the invention to provide multiple laminating layers, multiple planes in the non-separated portion of the cable, each containing both signal and ground wires, and multiple stacked separator members for the purpose of further separating the wires into more than two different planes at the point of termination. Also, the insulation may be applied by a cast-film process or by other similar processes. Consequently, the invention should be limited solely by the appended claims.

I claim:

1. A flat cable comprising:

a plurality of wires enclosed within an insulating material, said plurality of wires including two groups of wires; and means including separator members placed between said two groups of wires at predetermined intervals along the length of the cable for causing said two groups of wires to be respectively located in separate planes at said predetermined intervals along the length of the cable, and in substantially the same plane elsewhere along the cable.

2. A flat cable as claimed in claim 1, wherein said separator members are formed from polytetrafluoroethylene.

3. A flat cable as claimed in claim 1, wherein said separate planes are substantially parallel.

4. A flat cable as claimed in claim 1, wherein said two groups of wires comprise, respectively, a group of signal wires and a group of ground wires.

5. A flat cable as claimed in claim 4, wherein said insulating material comprises two layers laminated together around the ground and signal wires except in those areas where said separator members are located.

6. A method of manufacturing a cable, comprising the steps of: separately guiding two groups of wires to a station; merging said two groups of wires at said station into a single group of spaced wires located in substantially the same plane; at predetermined intervals, inserting separator members between said two groups of wires to cause said two groups of wires to be located in separate planes rather than merged into a single plane; and applying insulation to both said merged and separated groups of wires to form a cable.

7. A method as claimed in claim 6, wherein said station is a laminating station comprising pressures rollers, and wherein said step of applying insulation material to the wires to form a cable comprises the step of pressing separate layers of insulating material between said pressure rollers to sandwich the two groups of wires, said separator members preventing adhesion to each other of the respective layers of insulating material.

8. A method as claimed in claim 7, wherein said step of separately guiding two groups of wires comprises the steps of guiding a first group comprising signal wires to the station and guiding a second group comprising ground wires.

9. A method of separating wires of a flat cable, comprising the steps of:

providing a flat cable comprising a plurality of wires enclosed within an insulating material, said plurality of wires including two groups of wires, and separator members placed between said two groups of wires at predetermined intervals along the length of the cable, said two groups of wires being located approximately in a single plane except in the areas in which said separator members are placed between said two groups of wires;

cutting said cable at areas of the cable where said separator members are located; and separating the cable at said areas into sections each containing one of said two groups of wires.

10. A method as claimed in claim 9, wherein respective separator members remain attached to respective sections after separation of the sections, and said method further comprises the step of peeling away the separator members from the sections to which they remain attached.

11. A method as claimed in claim 9, wherein said two groups of wires each remains partially embedded in said insulating material after separation of said sections.

12. A method as claimed in claim 11, further comprising the step of removing said insulating material from at least one of said groups.

13. A method as claimed in claim 11, further comprising the step of removing said insulating material from only one of said groups.

14. A method as claimed in claim 9, wherein said step of separately guiding said two groups of wires comprises the steps of guiding a first group comprising signal wires to the station and guiding a second group comprising ground wires to the station.

* * * * *